US008511514B2

(12) United States Patent
Lee et al.

(10) Patent No.: US 8,511,514 B2
(45) Date of Patent: Aug. 20, 2013

(54) PUMPING DEVICE OF FLUID CONTAINER AND PRESS BUTTON

(75) Inventors: Hyun Seung Lee, Seoul (KR); Yong Uk Choi, Seoul (KR)

(73) Assignee: LG Household & Health Care Ltd. (KR)

( * ) Notice: Subject to any disclaimer, the term of this patent is extended or adjusted under 35 U.S.C. 154(b) by 49 days.

(21) Appl. No.: 13/259,297

(22) PCT Filed: Jul. 21, 2009

(86) PCT No.: PCT/KR2009/004036
§ 371 (c)(1),
(2), (4) Date: Sep. 23, 2011

(87) PCT Pub. No.: WO2011/007916
PCT Pub. Date: Jan. 20, 2011

(65) Prior Publication Data

US 2012/0006857 A1 Jan. 12, 2012

(30) Foreign Application Priority Data

Jul. 15, 2009 (KR) ..... 10-2009-0064460

(51) Int. Cl.
*B67B 1/00* (2010.01)

(52) U.S. Cl.
USPC ..... 222/153.13; 222/384; 222/383.1

(58) Field of Classification Search
USPC ..... 222/153.13, 153.01, 153.04, 383.1, 222/321.7, 321.8, 321.9, 209, 402.13, 153.03, 222/153.12, 153.14, 384; 220/592.18
See application file for complete search history.

(56) References Cited

U.S. PATENT DOCUMENTS

| | | | | |
|---|---|---|---|---|
| 3,848,778 | A * | 11/1974 | Meshberg | 222/402.11 |
| 4,324,351 | A * | 4/1982 | Meshberg | 222/402.11 |
| 5,203,478 | A * | 4/1993 | de Laforcade et al. | 222/402.13 |
| 5,887,760 | A * | 3/1999 | Johnson | 222/209 |
| 6,119,900 | A * | 9/2000 | Iwamoto et al. | 222/209 |

(Continued)

FOREIGN PATENT DOCUMENTS

| | | |
|---|---|---|
| CN | 1915758 A | 2/2007 |
| GB | 2356672 A | 5/2001 |

(Continued)

OTHER PUBLICATIONS

Chinese Office Action for Application No. 200980158544.8 dated Jan. 31, 2013.

*Primary Examiner* — Kevin P Shaver
*Assistant Examiner* — Bob Zadeh
(74) *Attorney, Agent, or Firm* — Lerner, David, Littenberg, Krumholz & Mentlik, LLP

(57) ABSTRACT

The present invention relates to a pumping device of a fluid vessel that discharges a predetermined amount of contents, and more particularly, to a push button of a pumping device of a fluid vessel including a push panel having a push part capable of being pushed by applying force on an upper front surface; and a connection rod formed at a lower end of the push panel and including a pump pressing part pushed as the push part is pushed and a rotation part serving as a central axis of an operation of the pump pressing part as the push part is pushed, a distance between the push part and the rotation part being longer than that between the pump pressing part and the rotation part, and a pumping device of a fluid vessel using the same.

11 Claims, 7 Drawing Sheets

(56) References Cited

U.S. PATENT DOCUMENTS

| | | | | |
|---|---|---|---|---|
| 6,871,798 | B2 * | 3/2005 | Mathiez | 239/302 |
| 7,377,408 | B2 * | 5/2008 | Kasting et al. | 222/321.8 |
| 7,798,369 | B2 * | 9/2010 | Ophardt | 222/180 |
| 2006/0113329 | A1 * | 6/2006 | Walters et al. | 222/383.1 |
| 2006/0138176 | A1 * | 6/2006 | Lasserre et al. | 222/321.8 |
| 2006/0180612 | A1 * | 8/2006 | Paas et al. | 222/182 |
| 2008/0099517 | A1 * | 5/2008 | Bougamont | 222/548 |
| 2009/0127293 | A1 * | 5/2009 | De Laforcade | 222/402.11 |

FOREIGN PATENT DOCUMENTS

| | | | | |
|---|---|---|---|---|
| JP | 03-029782 | A | 2/1991 | |
| JP | 10-258866 | A | 9/1998 | |
| JP | 2001-158462 | A | 6/2001 | |
| WO | WO 2011/007916 | * | 1/2011 | 222/383.1 |

* cited by examiner

PUMPING DEVICE OF FLUID CONTAINER AND PRESS BUTTON

CROSS REFERENCE TO RELATED APPLICATIONS

The present application is a national phase entry under 35 U.S.C. §371 of International Application No. PCT/KR2009/004036, filed Jul. 21, 2009, published in Korean, which claims priority from Korean Patent Application No. 10-2009-0064460, filed Jul. 15, 2009, all of which are incorporated herein by reference.

TECHNICAL FIELD

The present invention relates to a pumping device of a fluid vessel that discharges a predetermined amount of contents by pushing a push button installed at an opening of the fluid vessel and a push button thereof.

More particularly, the present invention relates to a pumping device that includes a push button adopting a leverage principle to easily discharge the contents of a vessel even though a user uses only one hand and can prevent the contents from being discharged due to unnecessary pushing of a push button while carrying or storing by providing a locker in the push button.

BACKGROUND ART

In general, in a vessel storing cosmetics, shampoos, detergents, and the like, at the time of discharging and using the contents contained in the vessel, a fluid vessel with a pumping device is used to more conveniently use the contents.

FIG. 1 is a diagram for describing a pumping device in the related art.

Referring to FIG. 1, a pumping device 1 including a pump 2 is shown. The pumping device 1 is coupled with a fluid vessel 4 storing the contents in a lower part thereof. The fluid vessel 4 includes an opened end 6 to which the pump 2 is fixed. The pump 2 may be permanently fixed to the opened end 6 of the fluid vessel 4, but may be removably fixed to the opened end 6 of the fluid vessel 4 by a thread shape or an attachment structure in the related art. In addition, a fluid outflow pipe 5 is formed in the pump 2 and a push button 3 is formed in an upper part of the pump 2.

In the pumping device in the related art, the push button 3 should be pushed in order to discharge a fluid contained in the fluid vessel 4 to the outside. Through a process in which the push button 3 is pushed and restored to an original position again, the pump 2 is actuated and the fluid in the fluid vessel is discharged to the outside through the fluid outflow pipe 5 by a pressure difference.

The fluid vessel with the pumping device adopts an additional protection cap (not shown) in order to prevent pumping. The protection cap, as a lid which is inserted into an upper end of the vessel with the pumping device while being spaced apart from the push button of the pumping device by a predetermined distance, prevents the push button from being pushed.

However, the protection cap is easily lost when carrying or storing the vessel and may be taken off when portable articles collide with each other or force is applied to the protection cap from the outside, such that the push button is exposed. Therefore, the push button is unintentionally pushed, such that the contents may flow out.

Another related art is a pumping device (not shown) with a locking means.

In the related art, the locking means represents a means for preventing the push button from being pushed by a stopping projection by rotating the push button part in one direction while pushing the push button part in order to prevent the contents from being discharged. In order to release the locking means, the push button is rotated in an opposite direction to be projected by avoiding the stopping projection. Therefore, in the pumping device with the locking means of the related art, the user should necessarily push and rotate the push button in order to seal the fluid vessel. In this case, since the push button was pushed, some of the contents flew out regardless of the user's intention, and as a result, the contents were wasted.

Further, at the time of using the fluid vessel adopting the pumping device or the pumping device with the locking means of the related art, the user generally took an action of pushing the push button with one hand and receiving the discharged fluid with the other hand. That is, since a method of transferring force directly to the pump pumping the fluid through the push button was used, it was difficult to receive the discharged fluid with a palm including the fingers other than the thumb while pushing the push button with one hand, specifically, only the thumb.

DISCLOSURE

Technical Problem

In order to solve the problems, an object of the present invention is to provide a push button adopting a leverage principle so as to easily discharge a fluid by enhancing the push button in a pumping device of a fluid vessel discharging the contents through a pumping device in the related art.

Further, an object of the present invention is to provide a pumping device of a fluid vessel capable of preventing a push button from being unintentionally pushed by providing a locker in the push button and locking a push button without wasting the contents even at the time of locking the push button in order to store or carry the fluid vessel.

In addition, an object of the present invention is to provide a pumping device of a fluid vessel that can allow a user to easily discharge the contents even with one hand.

Technical Solution

In order to achieve the above objects, a push button of a pumping device of a fluid vessel according to an exemplary embodiment of the present invention includes: a push panel having a push part capable of being pushed by applying force on an upper front surface; and a connection rod formed at a lower end of the push panel and including a pump pressing part pushed as the push part is pushed and a rotation part serving as a central axis of an operation of the pump pressing part as the push part is pushed, a distance between the push part and the rotation part being longer than that between the pump pressing part and the rotation part.

Preferably, a locker insertion groove may be formed in the connection rod and a locker capable of locking/unlocking the push button may be retractably inserted into the locker insertion groove. In addition, preferably, the locker may include a locker body inserted into the locker insertion groove and a locker head exposed to the top of the push panel. Herein, preferably, a locker head seating part embedded with the locker head may be formed in the push panel.

Further, preferably, a locking groove may be provided at the side of the locker body.

In order to achieve the objects, a pumping device of a fluid vessel according to an exemplary embodiment of the present invention includes: a push button including a push panel having a push part capable of being pushed by applying force on an upper front surface; and a connection rod formed at a lower end of the push panel and including a pump pressing part pushed as the push part is pushed and a rotation part serving as a central axis of an operation of the pump pressing part as the push part is pushed, a distance between the push part and the rotation part being longer than that between the pump pressing part and the rotation part; a housing body including a fastening groove fastened with the rotation part and connected with the fluid vessel; a housing cover including a rod insertion groove into which the connection rod is inserted and coupled with the housing body; and a fluid discharging pipe part positioned between the housing body and the housing cover to discharge a fluid in the fluid vessel.

Preferably, a locker insertion groove may be formed in the connection rod and a locker capable of locking/unlocking the push button may be retractably inserted into the locker insertion groove.

In addition, preferably, the locker may include a locker body inserted into the locker insertion groove and a locker head exposed to the top of the push panel.

In addition, preferably, a locker head seating part embedded with the locker head may be formed in the push panel.

Further, a locking groove inserted into one end portion of the rod insertion groove of the housing cover to lock an operation of the push button while the push button is pushed may be formed in the locker body.

Preferably, a locking hole inserted with a locking pin formed in the housing cover to lock the operation of the push button while the push button is pushed may be formed in the locker body.

Preferably, a discharging hole inserted with an end of the fluid discharging pipe part may be formed in the housing body. Further, preferably, a support part of which a portion at which the end of the fluid discharging pipe part is positioned has a concave shape may be formed in the hosing body.

Advantageous Effects

According to the present invention, a user can easily discharge the contents with only one hand due to a pumping device of a fluid vessel with a push button adopting a leverage principle and feel a smoother pumping sense than a pumping device in the related art.

Further, according to the present invention, it is possible to prevent the contents from flowing out due to unnecessary pushing of the push button at the time of distributing, not using, or carrying the fluid vessel due to the push button with a locker and to easily seal the vessel without wasting the contents.

BEST MODE

Figure 1:
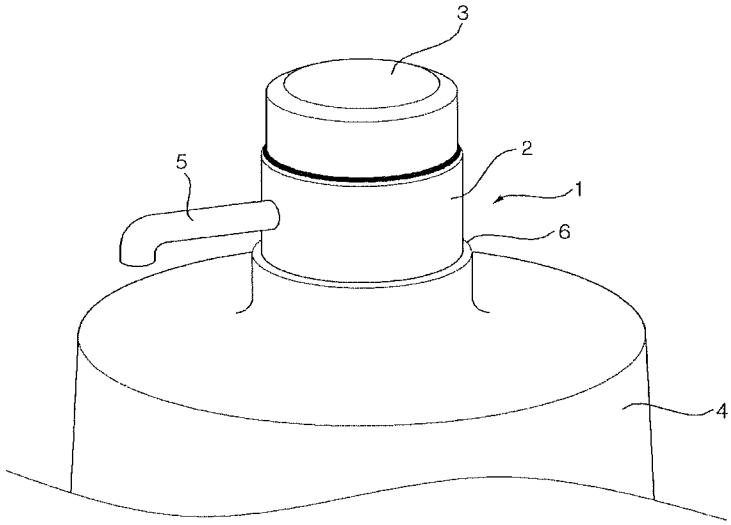
FIG. 1 is a diagram for describing a pumping device in the related art.

Hereinafter, exemplary embodiments of the present invention will be described in detail with reference to the accompanying drawings. First of all, it is to be noted that in giving reference numerals to elements of each drawing, like reference numerals refer to like elements even though like elements are shown in different drawings. The components and operations of the present invention illustrated in the drawings and described with reference to the drawings are described as at least one exemplary embodiment and the spirit and the core components and operation of the present invention are not limited thereto.

Figure 2:
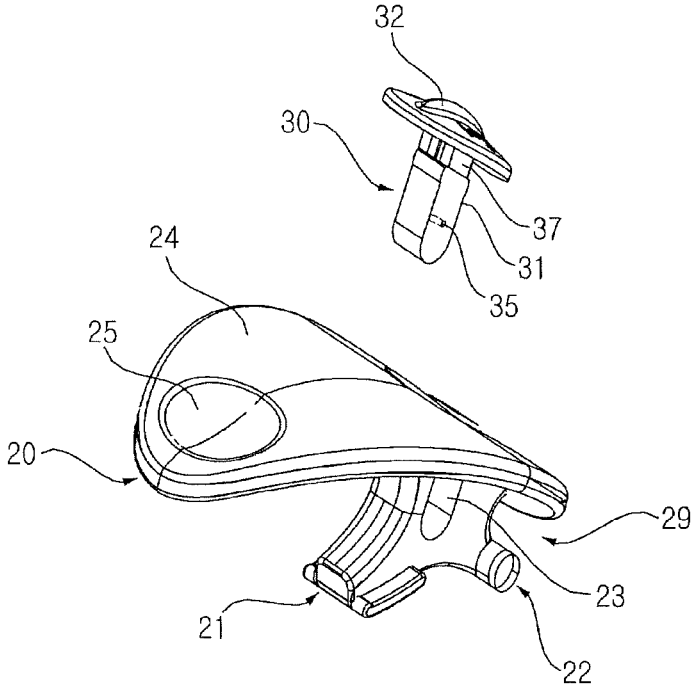
FIG. 2 is a diagram showing a structure of a push button according to an exemplary embodiment of the present invention.

FIG. 2 is a diagram showing a structure of a push button according to an exemplary embodiment of the present invention.

Referring to FIG. 2, the push button 20 is constituted by a connection rod 29 including a pump pressing part 21 and a rotation part 22 and a push panel 24 with a push part 25. As seen in FIG. 2, the push panel 24 may be manufactured in an oval shape and the push part 25 may be provided at one side of a top surface of the push panel 24. In the present invention, the push part 25 is used as a meaning designating a part of the push panel 24 which a user pushes to operate the push button 20. Herein, the pump pressing part 21 is a means that allows pumping to be performed by transferring a pressure to which the user applies to the push part 25 to a pump (not shown) connected with a fluid in a vessel. The rotation part 22 is a means that allows the pump pressing part 21 to press a pump in a fluid vessel by transferring the pressure applied to the push part 25 to the pump pressing part 21 provided in the connection rod 29 and serves as a central shaft for operating the push button 20.

In the present invention, in the push button 20, a distance between the push part 25 and the rotation part 22 is longer than that between the pump pressing part 21 and the rotation part 22. That is, an upper part of the connection rod 29 is connected with the push panel 24 and a lower part of the connection rod 29 includes the rotation part 22 and the pump pressing part 21, however, the distance between the push part 25 and the rotation part 22 should be longer than that between the pump pressing part 21 and the rotation part 22.

As seen in the structure of the push button 20 of FIG. 2, the push button 20 of the present invention adopts a leverage principle.

In order to assist understanding, a description of the leverage principle, i.e., a leverage effect will be disclosed below.

In a leverage are provided three primary points including a support point at which one point of a bar is supported and fixed by an object, a force point at which the force is applied to the leverage, and an action point (one point) at which the leverage reaches another object. A basic principle of the leverage is to use a moment of the force. 'The moment of the force' represents the multiplication of a weight of the object and a distance from the support point to the object and the moment of the force at both sides of the support point should be the same as each other in order to level the leverage. Therefore, even though large force is exerted at a location close to the support point and(or?) even though smaller force is exerted at a location further from and opposite to the support point, the leverage can be leveled. Therefore, in order to exerting small force to the force point and larger force to the action point, the support point is preferably positioned as close to the action point as possible. The leveling relationship of the moment can be expressed by [Equation] below.

$$L_1 \times F = L_2 \times W$$

$$F = W \times (L_2/L_1) \qquad \text{[Equation]}$$

Herein, W represents the weight of the object, F represents the force applied to the leverage, $L_1$ represents the distance from the support point to the force point, and $L_2$ represents the distance from the support point to the action point.

As shown in the Equation above, F, the magnitude of the force to raise W with the leverage has a close relationship with distances $L_1$ and $L_2$. That is, when $L_1 > L_2$, F which is the applied force is smaller than W, when $L_1 = L_2$, F is equal to W, and when $L_1 < L_2$, F which is the applied force is larger than W. That is, when a distance from the support point to a location to which the force is applied is longer than a distance from the support point to a location at which the object is positioned, a distance moved from the force point increases, however, the object can be raised with small force. That is, a gain of the force can be obtained.

A description is disclosed by applying the gain of the force to the present invention.

Figure 3:
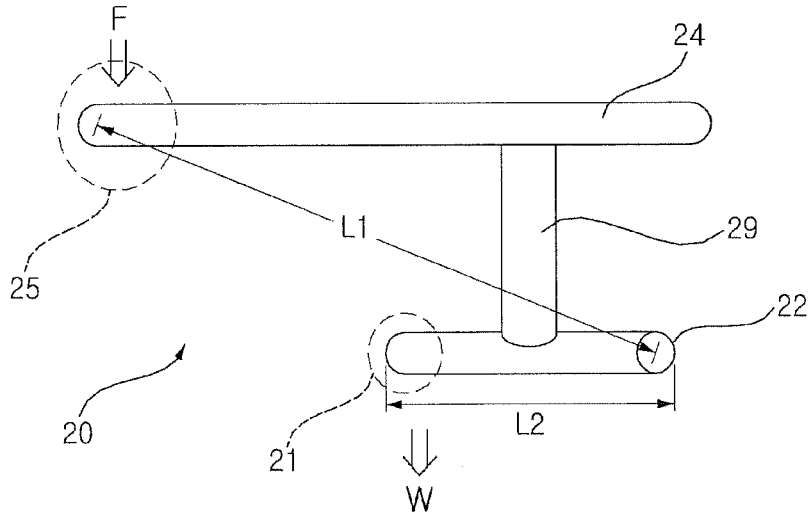
FIG. 3 is a diagram for describing a leverage principle adopted in the push button according to the present invention.

FIG. 3 is a diagram for describing a leverage principle adopted in the push button according to the present invention.

Referring to FIG. 3, in the present invention, the rotation part 22 is fastened to a fastening groove of a housing cover to be described below to become the support point, the pump pressing part 21 becomes the action point, and the push part 25 of the push panel 24 becomes the force point. That is, when the distance between the push part 25 and the rotation part 22 is represented by $L_1$ and the distance between the rotation part 22 and the pump pressing part 21 is represented by $L_2$, the relationship of $L_1 > L_2$ is satisfied and thus [Equation] is applied, such that the force W which the pump pressing part 21 exerts to the outside is larger than the force F exerted to the push part 25. Accordingly, in the case of the push button according to the present invention, a pumping operation can be performed by pushing the push button with smaller force.

Hereinafter, a description of the operations of the push button and a locker according to an exemplary embodiment of the present invention will be disclosed in detail.

Figure 4:
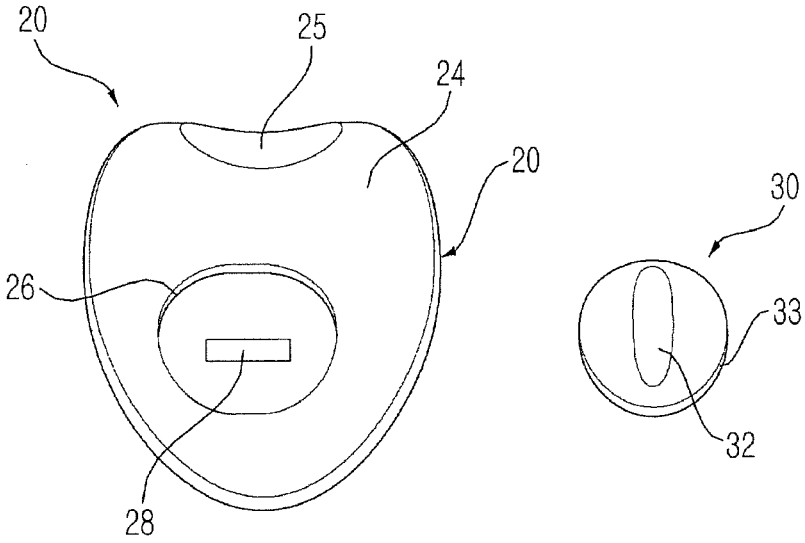
FIG. 4 is a diagram showing a push panel and a locker according to an exemplary embodiment of the present invention.

FIG. 4 is a diagram showing a push panel and a locker according to an exemplary embodiment of the present invention.

As shown in FIGS. 2 and 4, the locker may be constituted by a locker head 32 having a predetermined area directly contacting the user and a locker body 31 formed at a lower end portion of the locker head 32 and the locker 30 having a fastening part 37 may be formed by fastening the locker head 32 and the locker body 31 that are separated from each other.

The locker 30 serves to lock or unlock the operation of the push button 20. That is, the user can control the operation of the push button 23 by moving the locker head 32.

In the present invention, a guide groove 28 is formed in the push panel 24 and a locker insertion groove 23 is formed in the connection rod 29. The guide groove 28 elongates in one direction so that the locker 30 is inserted thereinto to move in both directions and the locker insertion groove 23 formed in the connection rod 29 is formed so that the locker body 31 is exposed to the outside of the connection rod 29 as the locker 30 moves.

Alternatively, the locker 30 may be formed by fastening the locker head 32 and the locker body 31 around a locker head seating part 26 formed in the upper part of the push panel 24. Substantially, the fastening part 37 of the locker 30 is formed to be concave as compared with the locker body 31 and the locker body 31 is guided while being inserted into the guide groove 28 formed in the push panel 24. As a result, when the user operates the locker 30, the locker 30 moves horizontally along the guide groove 28. Therefore, the locker 30 inserted into the locker insertion groove 23 may serve to control the push button 20 without being separated from the locker insertion groove 23.

Next, the pumping device of the fluid vessel according to the exemplary embodiment of the present invention having the push button will be described.

Figure 5:
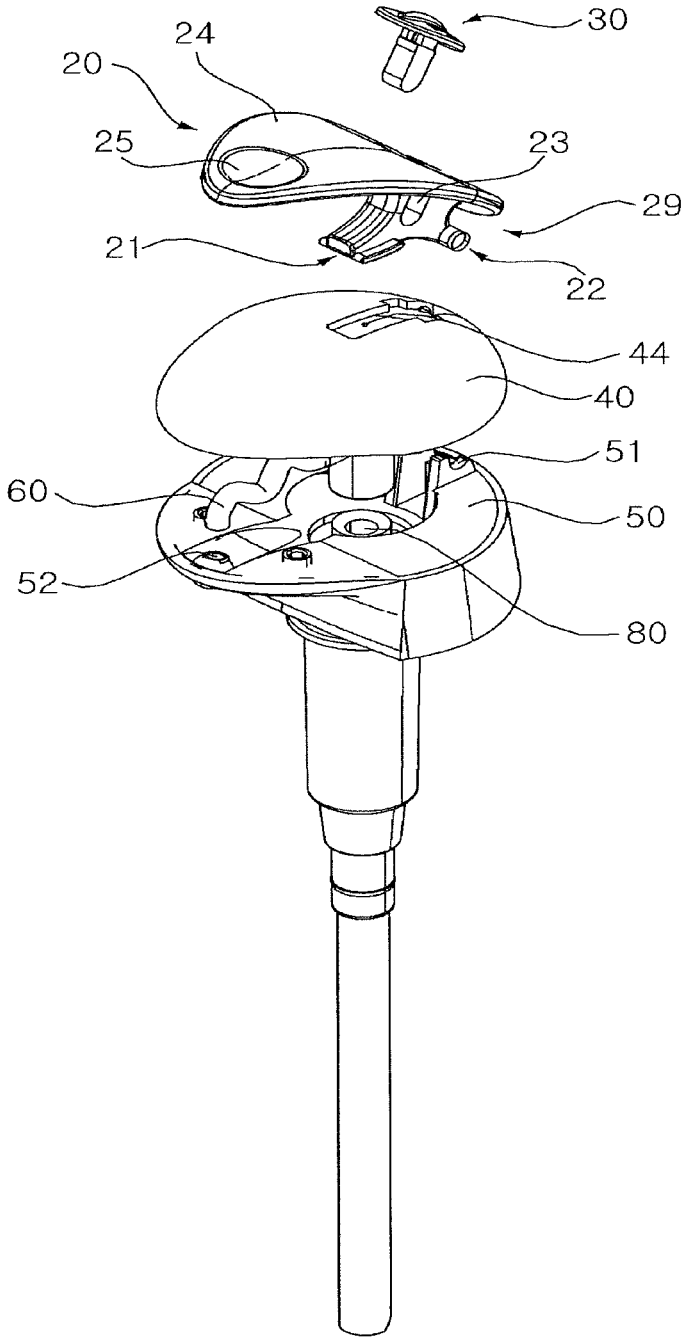
FIG. 5 is a diagram showing a structure of a pumping device according to an exemplary embodiment of the present invention.
Figure 6:
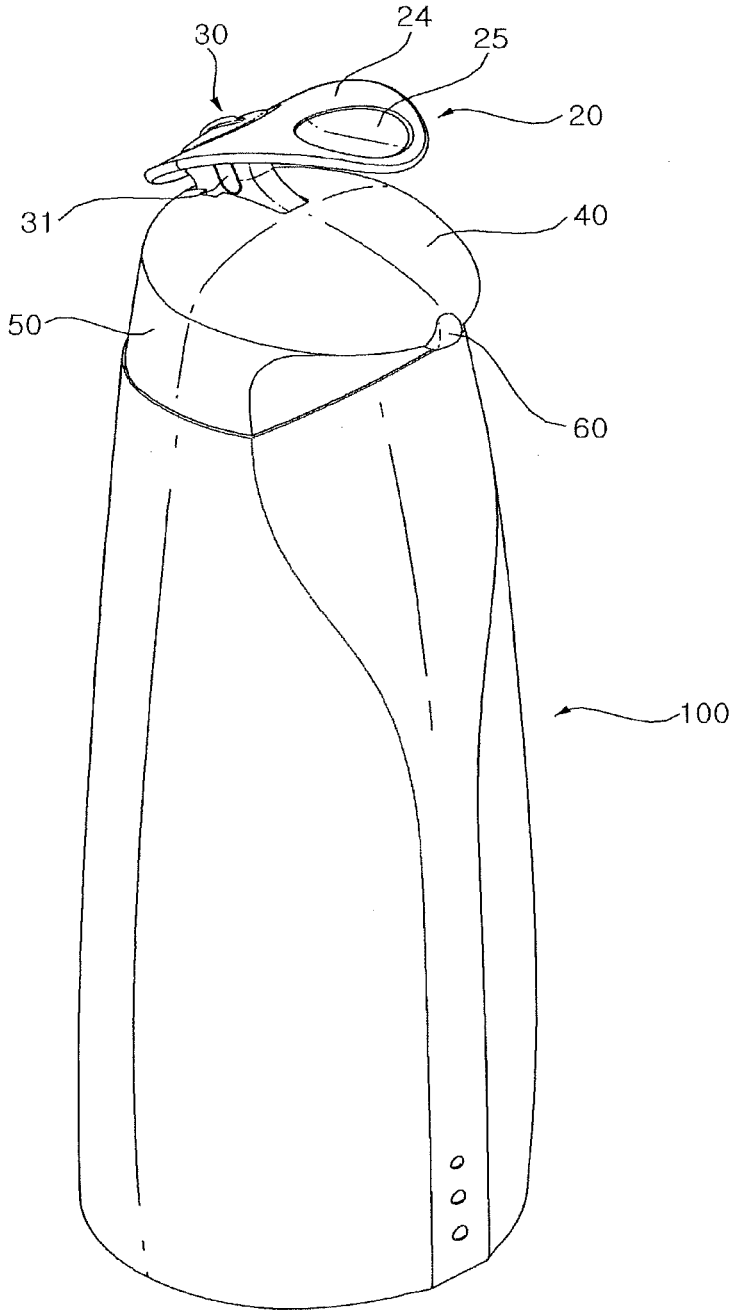
FIG. 6 is a diagram showing a state in which the pumping device according to the exemplary embodiment of the present invention is coupled with a fluid vessel.

FIG. 5 is a diagram showing a structure of a pumping device according to an exemplary embodiment of the present invention, and FIG. 6 is a diagram showing a state in which the pumping device according to the exemplary embodiment of the present invention is coupled with a fluid vessel.

Referring to FIGS. 5 and 6, it can be seen that the locker 30 and the push button 20 are coupled with a housing cover 40 and a housing body 50 to form the pumping device.

The housing body 50 includes a fastening groove 51 fastened with the rotation part 22 of the push button 20 and is connected with a pump 80 serving to pump the fluid in a fluid vessel 100.

The housing cover 40 includes a rod insertion groove 44 into which the connection rod 29 of the push button 20 is inserted and is fastened with the housing body 50. Further, a fluid discharging pipe part 60 is positioned between the housing cover 40 and the housing body 50.

An upper portion of the fluid discharging pipe part 60 is connected with the pump pressing part 21 and a lower portion thereof is connected with the pump 80. The fluid in the fluid vessel 100 is discharged through an end of the fluid discharging pipe part 60. Further, a discharging hole into which the end of the fluid discharging pipe part 60 is inserted is formed in the housing body 50, and is inserted with the end of the fluid discharging pipe part.

The locker 30 and the push button 20 have been described above in detail.

Referring to FIG. 5, an exemplary embodiment in which the pumping device according to the present invention operates is disclosed.

When the pressure generated as the user presses the push part 25 is transferred to the pump pressing part 21 around the rotation part 22, the pump pressing part 21 applies the pressure to the upper portion of the fluid discharging pipe part 60 connected with the pump 80. Therefore, pumping by the pump 80 is performed, such that the fluid is discharged through the fluid discharging pipe part 60 connected with the pump 80.

Meanwhile, the housing cover 40 and the housing body 50 may be coupled with each other in a structure in which the outer periphery of the housing body 50 and the outer periphery of the housing cover 40 engage with each other, bonded to each other by an adhesive, or fastened with each other by using an additional fastening device for coupling. As such, the housing cover 40 and the housing body 50 may be fastened with each other by various methods known to those skilled in the art.

Hereinafter, a description of the operations of the push button and the locker according to an exemplary embodiment of the present invention will be disclosed in detail.

Figure 7:
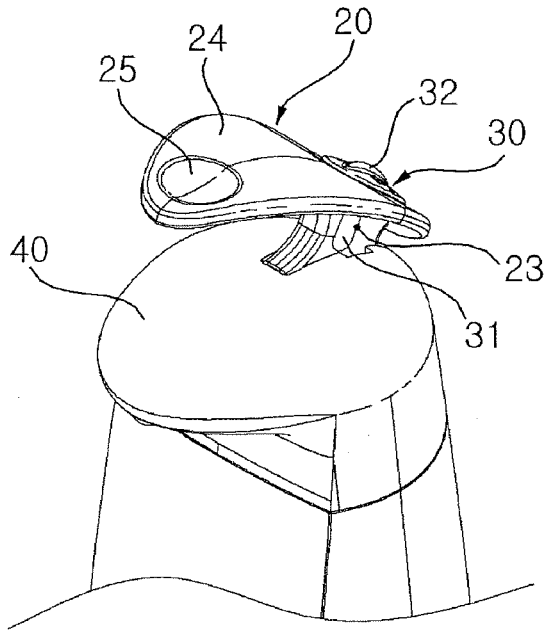
FIG. 7 is a diagram showing an unlocked state of a push button according to an exemplary embodiment of the present invention.
Figure 8:
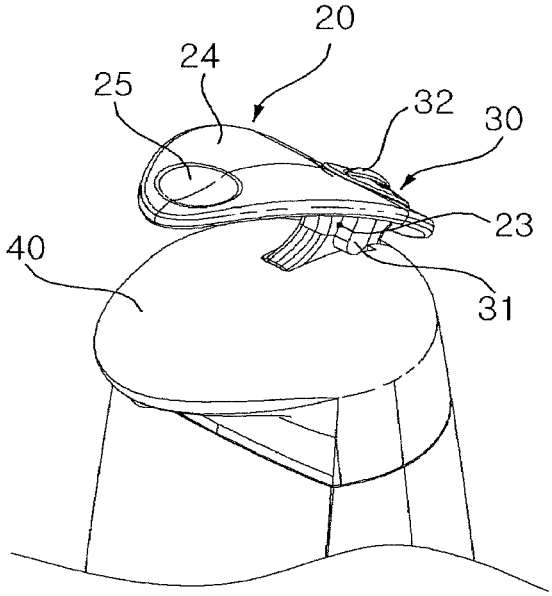
FIG. 8 is a diagram showing a locked state of a push button according to an exemplary embodiment of the present invention.

FIG. 7 is a diagram showing an unlocked state of a push button according to an exemplary embodiment of the present invention, and FIG. 8 is a diagram showing a locked state of a push button according to an exemplary embodiment of the present invention.

Referring to FIG. 7, the locker 30 inserted into the push button 20 is at an unlocking position, which enables the push button 20 to operate. Therefore, since the locker body 31 of the locker 30 is positioned in the locker insertion groove 23 of the push button 20, when the user pushes the push part 25 of the push button 20 to perform the pumping operation, the user is not resisted by the locker 30.

On the contrary, as shown in FIG. 8, when the locker 30 inserted into the push button 20 is at a locking position, the push button 20 does not operate. That is, since the locker body 31 of the locker 30 protrudes outside the locker insertion groove 23 of the push button 20 to be positioned on the top surface of the housing cover 40, the push button 20 is resisted by the locker 30 supported by the housing cover 40 to be inoperative even though the user pushes the push part 25 of the push button 20.

Next, a description of an aspect of the operation of the pumping device of the fluid vessel according to the exemplary embodiment of the present invention will be disclosed.

Figure 9:
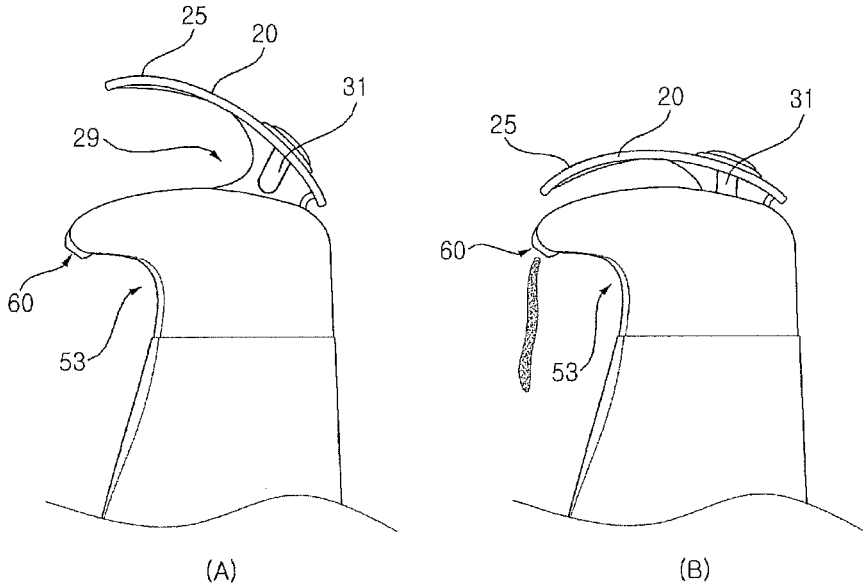
FIG. 9 is a diagram showing a use state of the pumping device according to the exemplary embodiment of the present invention.

FIG. 9 is a diagram showing a use state of the pumping device according to the exemplary embodiment of the present invention.

FIG. 9(A) shows an ordinary state of the pumping device, and FIG. 9(B) shows the use state of the pumping device, that is, a state in which the push button 20 is pushed. When the user pushes the push part 25 of the push button 20, a predetermined amount of the contents of the fluid vessel is discharged from the end of the fluid discharging pipe 60. That is, as the push button 20 is pressed, the push button 20 operates around the rotation part 22 as a central axis, such that the pump pressing part 21 presses the upper portion of the fluid discharging pipe 60 and the pressure is transferred to the pump 80 connected with the fluid discharging pipe 60. Therefore, pumping is performed, such that the fluid is discharged (see FIG. 5).

Meanwhile, referring to FIG. 9, the pumping device according to the exemplary embodiment of the present invention can perform the pumping operation by using only any one hand of a right hand and a left hand of the user. To this end, in an exemplary embodiment of the present invention, a support part 53 is provided in the housing body. The support part 53 may have a concave shape and the user positions his/her index finger in the support part 53 and pushes the push part 25 of the push button 20 with the thumb. In this case, the fingers other than the thumb and the index finger and the palm part are naturally positioned below the end of the fluid discharging pipe 60 to receive the discharged fluid.

The above-mentioned support part 53 may have the concave shape and may be formed by inserting the index finger into an additional ring. That is, in the present invention, the support part 53 represents a means provided so that the user stably performs the pumping operation with only one hand.

Meanwhile, the locker according to the exemplary embodiment of the present invention includes a means capable of controlling the operation of the push button in the locker body. A description thereof is disclosed using the figures.

Figure 10:
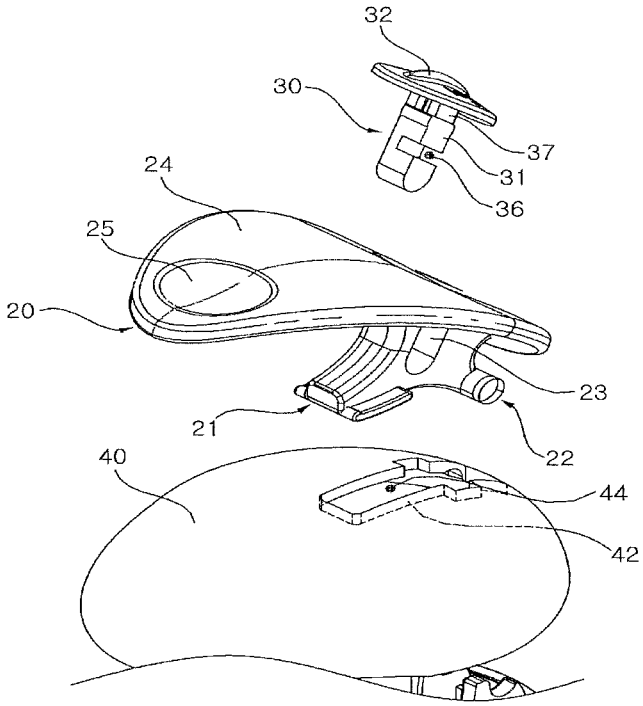
FIG. 10 is a diagram showing structures of a locker and a housing cover according to another exemplary embodiment of the present invention.
Figure 11:
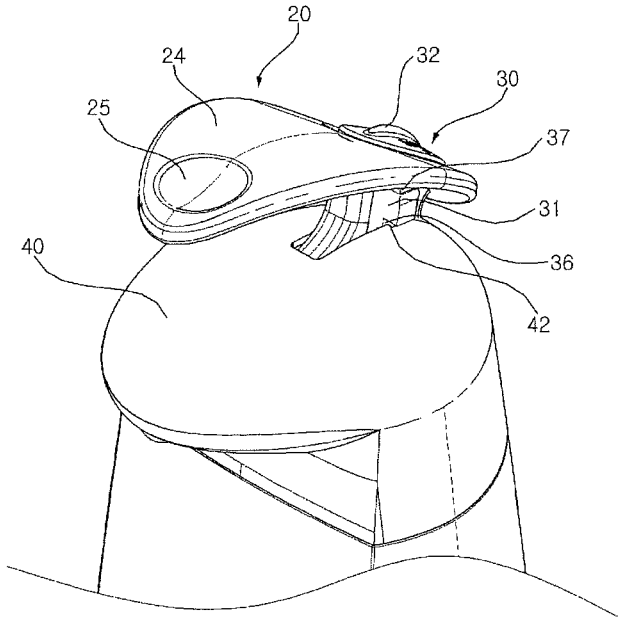
FIG. 11 is a diagram showing a state in which the locker is inserted into one end portion of a rod insertion groove of the housing cover according to another exemplary embodiment of the present invention.

FIG. 10 is a diagram showing structures of a locker and a housing cover according to another exemplary embodiment of the present invention, and FIG. 11 is a diagram showing a state in which the locker is inserted into one end portion of a rod insertion groove of the housing cover according to another exemplary embodiment of the present invention.

Referring to FIGS. 10 and 11, when the locker 30 moves to the locking position while the push button 20 is pushed, one end portion 42 of the rod insertion groove 44 of the housing cover 40 is inserted into a locking groove 26 to be fixed to the locking groove 26 while the push button 20 is pushed.

Therefore, when the fluid vessel according to the present invention is firstly shipped or the fluid vessel is carried or stored as necessary while using the fluid vessel, the push button 20 may be fixed while being pushed as described above, and as a result, it is possible to prevent the push button 20 from being damaged during moving the vessel.

Figure 12:
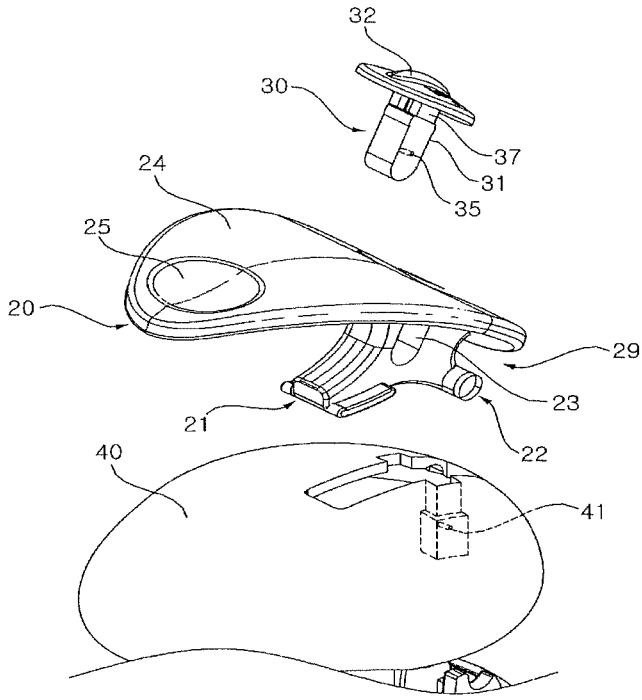
FIG. 12 is a diagram showing structures of a locker and a housing cover according to yet another exemplary embodiment of the present invention.

FIG. 12 is a diagram showing structures of a locker and a housing cover according to yet another exemplary embodiment of the present invention.

Referring to FIG. 12, a fixation hole 35 is formed in the locker body 31 and a fixation pin 41 inserted into the fixation hole 35 of the locker body 31 is provided in the housing cover 40.

Therefore, when the locker 30 moves to the locking position while the push button 20 is pushed, the fixation pin 41 is inserted into the fixation hole 35 to be fixed while the push button 20 is pushed.

Therefore, when the fluid vessel according to the present invention is firstly shipped or the fluid vessel is carried or stored as necessary while using the fluid vessel, the push button 20 may be fixed while being pushed as described above, and as a result, it is possible to prevent the push button 20 from being damaged during moving the vessel.

The present invention described up to now is not limited to the above-mentioned exemplary embodiments and as seen in the appended claims, the present invention can be changed by those skilled in the art and the changes are included in the scope of the present invention.

The invention claimed is:

1. A push button of a pumping device of a fluid vessel, comprising:

a push panel having a push part capable of being pushed by applying force on an upper front surface; and a connection rod formed at a lower end of the push panel, the connection rod including a pump pressing part and a rotation part, the pump pressing part being pressed as the push part is pressed, the rotation part serving as a central axis of an operation of the pump pressing part as the push part is pressed, wherein a distance between the push part and the rotation part is configured to be longer than that between the pump pressing part and the rotation part;

wherein a locker insertion groove is formed in the connection rod and a locker capable of locking or unlocking the push button is retractably inserted into the locker insertion groove.

2. The push button of a pumping device of a fluid vessel according to claim 1, wherein the locker includes a locker body inserted into the locker insertion groove and a locker head exposed to the top of the push panel.

3. The push button of a pumping device of a fluid vessel according to claim 2, wherein a locker head seating part embedded with the locker head is formed in the push panel.

4. The push button of a pumping device of a fluid vessel according to claim 2 or 3, wherein a locking groove is provided at the side of the locker body.

5. A pumping device of a fluid vessel, comprising:

a push button including a push panel having a push part capable of being pushed by applying force on an upper front surface; and a connection rod formed at a lower end of the push panel, the connection rod including a pump pressing part and a rotation part, the pump pressing part being pressed as the push part is pressed, the rotation part serving as a central axis of an operation of the pump pressing part as the push part is pressed, wherein a distance between the push part and the rotation part is configured to be longer than that between the pump pressing part and the rotation part;

a housing body including a fastening groove fastened with the rotation part and connected with the fluid vessel;

a housing cover including a rod insertion groove into which the connection rod is inserted and coupled with the housing body; and a fluid discharging pipe part positioned between the housing body and the housing cover to discharge a fluid in the fluid vessel;

wherein a locker insertion groove is formed in the connection rod and a locker capable of locking or unlocking the push button is retractably inserted into the locker insertion groove.

6. The pumping device of a fluid vessel according to claim 5, wherein the locker includes a locker body inserted into the locker insertion groove and a locker head exposed to the top of the push panel.

7. The pumping device of a fluid vessel according to claim 6, wherein a locker head seating part embedded with the locker head is formed in the push panel.

8. The pumping device of a fluid vessel according to claim 6 or 7, wherein a locking groove inserted into one end portion of the rod insertion groove of the housing cover to lock an operation of the push button while the push button is pushed is formed in the locker body.

9. The pumping device of a fluid vessel according to claim 6 or 7, wherein a locking hole inserted with a locking pin formed in the housing cover to lock the operation of the push button while the push button is pushed is formed in the locker body.

10. The pumping device of a fluid vessel according to claim 5, wherein a discharging hole inserted with an end of the fluid discharging pipe part is formed in the housing body.

11. The pumping device of a fluid vessel according to claim 5, wherein a support part of which a portion at which the end of the fluid discharging pipe part is positioned has a concave shape is formed in the hosing body.

* * * * *